United States Patent [19]

Jaouannet et al.

[11] 4,348,685

[45] Sep. 7, 1982

[54] WRITING HEAD FOR AN ELECTROSTATIC POINT PRINTER

[76] Inventors: Alain Jaouannet, 5, rue E. Branly; Louis G. Henaff, Pon an Allée, both of Perros Guirec, France, 22700; Jean-Pierre R. Ramy, 3, Résidence Duroux, Lannion, France, 22300

[21] Appl. No.: 149,422

[22] Filed: May 13, 1980

[30] Foreign Application Priority Data

May 14, 1979 [FR] France ..... 79 12225

[51] Int. Cl.[3] ..... G03G 15/048

[52] U.S. Cl. ..... 346/155

[58] Field of Search ..... 346/155, 139 C; 107/DIG. 13

[56] References Cited

U.S. PATENT DOCUMENTS 4,096,489 6/1978 Tarazawa et al. ..... 346/155
4,163,980 8/1979 Angelbeck et al. ..... 356/155
4,215,355 7/1980 Moore ..... 346/155
4,287,525 9/1981 Tagawa ..... 346/155

FOREIGN PATENT DOCUMENTS 52-34710 3/1977 Japan ..... 346/155

OTHER PUBLICATIONS

IBM Technical Disclosure Bulletin-vol. 19, No. 8, Jan. 1977—p. 2986.

*Primary Examiner*—Stuart N. Hecker
*Attorney, Agent, or Firm*—Lowe, King, Price & Becker

[57] ABSTRACT

An electrostatic point printer head includes a dielectric substrate that carries a plurality of point electrodes, a connector and a network of conductors enabling interconnections between the several electrodes and with the connector. The dielectric substrate is a sheet fixed by one of its surfaces to a rigid support; the network of conductors comprises tracks plated on both surfaces of the substrate sheet and the electrodes are contact studs passing through the thickness of the substrate.

10 Claims, 4 Drawing Figures

WRITING HEAD FOR AN ELECTROSTATIC POINT PRINTER

BACKGROUND OF THE INVENTION

1. Field of the Invention

The invention relates to a writing head for electrostatic point printers of the type in which the writing head is fixed and comprises at least one row of point electrodes in front of which a printing support (dielectric sheet or paper having a dielectric layer) passes.

In certain electrostatic printers of this type counter-electrodes co-operate with the electrodes to cause electrostatic discharges which sensitize the printing support the counter-electrodes are disposed opposite the printing head electrodes on the other side of the printing support. This printing support therefore passes between the head and the counter-electrodes and remains in contact with the latter, but is generally separated from the electrodes by a gap in the range of several microns. An electrical voltage is always provided between all the electrodes and counter-electrodes; however the support opposite a given electrode is only sensitized when this voltage exceeds a predetermined threshold value.

In the case of a second type of electrostatic printers of the above-mentioned type, the counter-electrodes are strips supported by the printing head to form at least one row which passes along a row of electrodes. As the printing support moves, it remains in contact with both the electrodes and counter-electrodes.

In both categories of printers, a counter-electrode co-operates with a group of electrodes. In order to decrease the number of electronic switches enabling the electrode supply to be ensured, use is made of multiplexing possibilities. More precisely, an electrical control pulse for a particular electrode is directed toward this electrode by two switches, one of which controls a conductor network associated with a counter-electrode or with the corresponding group of electrodes. The other switch controls a circuit for an electrode of predetermined rank in each of these groups.

The writing heads of the printers belonging to the above-mentioned two categories type are prismatic and moulded. The electrodes are parallel points disposed in this prism. Operative ends of the electrodes are flush with a section or a ridge of the prism; the electrode assembly include at least one comb of enamelled conductor wires coated with a dielectric material such as epoxy resin. When the head supports counter-electrodes the counter-electrodes includes metallic tracks parallel to the row of corresponding electrodes. These moulded heads are of a complicated construction, as it is difficult to maintain the alignment, the parallelism and the equidistance of the electrode wires with the required accuracy before and during the moulding operation. In addition, multiplexing requires numerous interconnections between the wire. As the pitch of the electrodes decreases (i.e., as the axial distance between enighboring electrodes decreases) the connection points become more difficult to construct. It is noted that the connection points are the more difficult to construct, the smaller the pitch of the electrodes (i.e. their axial distance). In the case of modern printers the pitch of a row is approximately 0.25 mn, event though the electrodes are disposed in a staggered formation (i.e. in two parallel, staggered rows) to prevent the risk of inadvertent discharges between neighbouring electrodes.

2. Description of the Prior Art

It has already been proposed (see for example the article of Schayes and Gustin, ACTA ELECTRONICA, No. 21, January 1978, pages 93–96) to construct printed circuit printing heads. A printed circuit formed on a dielectric substrate, comprises two networks of narrow, parallel metallic tracks. These two networks, juxtaposed end to end on the substrate, have a common straight line boundary. The pitch of each of the networks is double the pitch determined for the electrodes; they are offset with respect to each other by an electrode pitch, i.e. half a network pitch. The substrate is then cut along the common boundary and the two printed half-circuits are pressed and glued, with the tracks facing inwardly, with the interposition of a thin insulating layer. A sandwich obtained in this way in which all the tracks are inserted, is then rectified to make the track ends constituting the electrodes flush. The electrodes are interconnected by means of metallic tracks printed on the external surfaces of the sandwich and connected to the electrodes by metallized plated walls on through holes provided through the substrate material.

The above-described method counters the difficulties associated with positioning of the wires and electrode interconnections which arise in the moulding method. However, the pressing and gluing step requires great precautions. It is, in effect, the necessary to monitor the position of the two half-circuits to very strict tolerances and to be sure that the pressing and gluing step does not cause the two half-circuits to slip with respect to each another. In addition, the possible positioning of counter-electrodes on the head in the vicinity of the electrodes may only be carried out after rectification. The above document does not mention such counter-electrodes. In effect, this method would appear to be difficult to apply to the construction of heads supporting counter-electrodes.

SUMMARY OF THE INVENTION

The invention relates to a fixed writing head, that may or may not be provided with counter-electrodes, which may be obtained by printed circuit techniques. However, manufacturing of the head does not require cutting of the printed circuit or gluing the surfaces thereof together. The causes of the above-described defects are therefore eliminated. All the electrode connection and interconnection circuits, as well as the counter-electrodes and their connections, are obtained by double surface or multilayer photoengraving.

In accordance with its most general definition, the present invention provides a writing head for an electrostatic point printer comprising a dielectric substrate, that carries a plurality of point electrodes, a connector and a network of conductors for interconnecting the electrodes with each other and the connector. The dielectric substrate is a sheet fixed by one of its surfaces, herein termed the internal surface, to a rigid support, the conductor networks comprise leads plated on the internal surface of the substrate. The electrodes are contact studs connected to the leads and pass through the thickness of the substrate so they are flush with the opposite surface of the substrate, herein termed the external surface.

Advantageously, the conductor network additionally comprises leads plated on the external surface of the substrate, connected on one hand to the connector and, on the other hand, by means of connections passing through the substrate, to the leads plated on the internal surface. These connections are advantageously walls of plated through holes.

If the head additionally comprises counter-electrodes, the counter-electrodes are strips fixed to the external surface of the substrate and are connected to the connector by tracks plated on the substrate.

Operational improvements is obtained by placing a metallic component at a certain potential opposite the "electrode-counter-electrode" zone and the insulating surface of the paper.

BRIEF DESCRIPTION OF THE DRAWINGS

Further arrangements and advantages of the invention will be described in the following description of several embodiments, with reference to the attached drawings, in which.

Figures 1, 4:
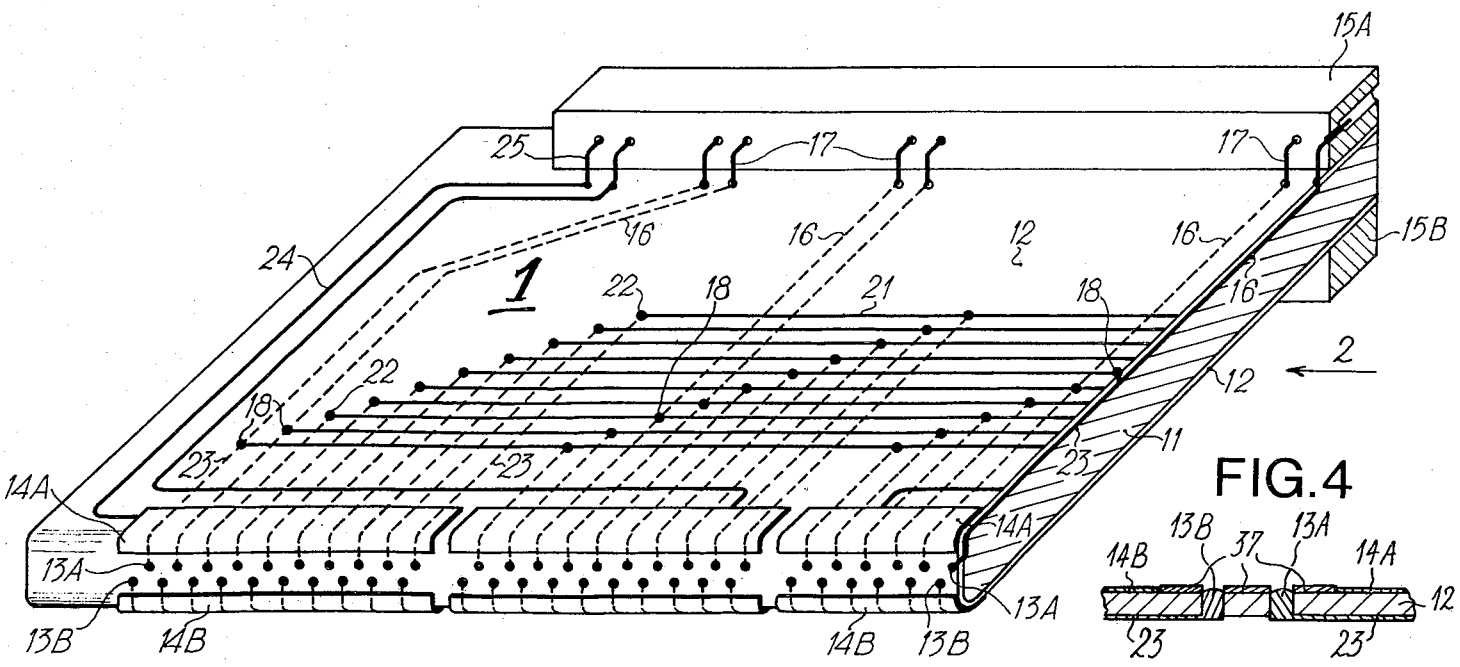
FIG. 1 is a perspective view of a portion of the electrostatic printing head of the invention, in accordance with a first embodiment.
FIG. 4 is an illustration of constructional detail designed to protect the counter-electrodes against abrasion.
Figure 2:
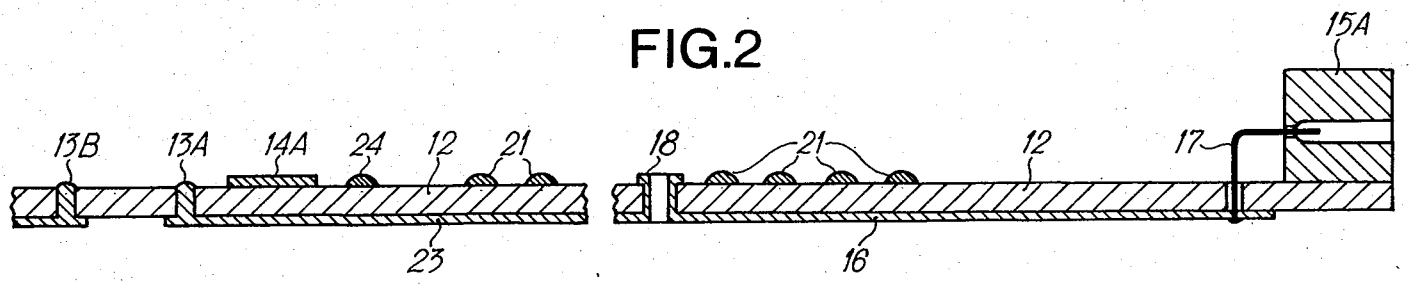
FIG. 2 is a section of the printed circuit of the head of FIG. 1, shown during an intermediate manufacturing stage.
Figure 3:
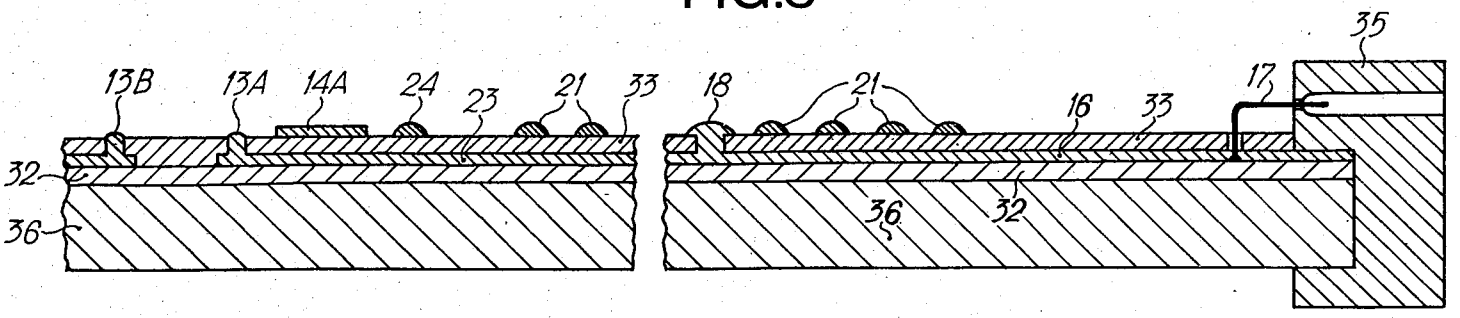
FIG. 3 is a section of another embodiment of the printed circuit, also shown during an intermediate manufacturing stage.

The scale of FIGS. 2 and 3 is greater than that of FIG. 1. In addition, so that the Figures are clear, certain dimensions such as the thicknesses, the distances between electrodes, etc. are shown on a scale which is much larger than other dimensions.

DESCRIPTION OF THE PREFERRED EMBODIMENTS

In FIG. 1, the printing head 1 is sectioned in such a way that it is possible to see, starting from the inside and going outwards, the rigid substance support 11 which is a flat, rectangular prism or plate made of an electrical insulating, dielectric material such as an epoxy resin, then the substrate 12 which is a flexible sheet of dielectric material (dielectric sheet means) such as polyimide and which is glued to the support 11 so as to coat the two surfaces and the front portion, i.e. that portion with which the rows of point, electrostatic printing electrodes 13 are flush. In other words head 1 includes a rigid dielectric plate 11 having first and second faces with first and second edges between the first and second faces. Dielectric sheet means 12 includes first, second and third portions that respectively extend in abutting relation over the first and second faces and one of the edges of plate 11. A set of spaced electrostatic printing electrodes 13 extends through the third portion of sheet means 12, between opposite first and second faces of the sheet means. For the reasons mentioned above, the electrodes 13 are distributed in a staggered formation of two rows of electrodes 13A and electrodes 13B cooperating respectively with a plurality of counter-electrodes 14A and a plurality of counter-electrodes 14B.

Two connector sockets 15A and 15B of a connector between leads 16 and 23 and control conductors (not shown) are respectively glued to the rear portion of head 1. Their front surfaces of sockets 15A and 15B which are hidden and which receive the terminals of the control conductors of the head (not shown), are substantially flush with the rear portion of the head. The conductor networks which provide, on one hand, on the upper visible surface of the head, the interconnection of the electrodes 13A and the connection of these electrodes and the counter-electrodes 14A with the socket 15A and, on the other hand, on the lower hidden surface of the head, the interconnection of the electrodes 13B and the connection of these electrodes and the counter-electrodes with the sockets 15B, have identical arrangements. For this reason, a description is only made of the wire or conductor network on the upper surface of support 11 and substrate 12. This conductor network comprises:

leads 16 plated on the internal surface of the substrate 12 (i.e. on the surface glued to the substrate support 11) and disposed transversely to the front portion of the head to (where point electrodes 13 are exposed) provides connections between output conductors 17 of the socket 15A and connection points 18 passing through the thickness of the substrate 12;

leads 21 plated on the external surface of the substrate 12, disposed parallel to the front portion of the head and providing connections between the connection points 18 and the connection points 22 which also pass through the thickness of the substrate 12;

leads 23 plated on the internal surface of the substrate 12, also disposed transversely to the front portion of the head and enabling the connections between the connection points 18 or 22 and the electrodes 13A;

finally leads 24 plated on the external surface of the substrate 12, ensuring the connection between the output conductors 25 of connector half 15A and the counter-electrodes 14A. Thus the first and second portions of the dielectric sheet means 12 include: a first set of parallel electric leads 16 on the face of the sheet means abutting against the faces of plate 11 and extending at right angles to the first edge of the plate from which electrodes 13 extend. On a second face of sheet means 12, opposite from the face of the sheet means which carries leads 16, is a second set of parallel leads 21 that extend at right angles to leads 16. Thereby, a matrix of leads is formed on the opposite faces of the first and second portions of sheet means 12. Metal plated through holes 18 extend through the first and second portions of sheet means 12 between segments of leads 16 in register with segments of leads 21 to form electrical connections, i.e., contacts passing through the thickness of substrate sheet means 12, between selected ones of leads 16 and 21. The connector including connector segments 15A and 15B extends over the second edge of plate 11, parallel to and remote from the first edge from which electrodes 13 extend.

FIG. 2 is a partial sectonal view, along the arrow 2 of FIG. 1, of an intermediate state, i.e. before folding and adhering to the substrate support 11 (FIG. 1), of the double surface printed circuit formed by the substrate 12, electrodes, 13A, 13B counter-electrodes 14A, internal leads 16, 23, external lead 21, 24 and connection point 18. The holes for lodging the wire sections 17, the electrodes 13 and the connection points 18 or 22 are provided by selective chemical action through a mask. Understanding of FIG. 2 requires few comments, as it shows the connector half 15A, an internal lead 16, an internal leads 23, a connector point 18 constituted by the metallised walls of the housing aperture, i.e. a plated through hole, two contact studs respectively constituting an electrode 13A and an electrode 13B (the latter not being visible normally as it is offset) and a counter-electrode 14A plated on the external surface of the substrate.

The printed circuit of FIG. 2 is, as stated above, of the double surface type, having two surfaces that may be readily obtained by photoengraving. The "multi-layer" technique may also be used for the construction of the printing head of the invention.

FIG. 3 is a section showing a construction of this type. The substrate support 36 is, in this example, a rigid metallic plate that is covered by an insulating layer 32. The internal leads 16 and 23 are formed on insulating layer 32 by photoengraving. A second insulating layer 33, which constitutes the substrate itself, in the sense given in the general description of the invention, is deposited on the insulating layer 32 and on the internal leads 16 and 23. The holes for housing the electrodes 13 and the connection points such as 22 are provided by chemical action. The socket 35 grips the support 36 and the first insulating layer 32. As in the embodiment of FIG. 2, the counter-electrodes 14 and the external tracks 21 and 24 are formed by photoengraving. It is obviously possible to select a substrate support of insulating material, instead of the metallic substrate support 36. The first insulating layer 32 is then redundant. In addition, the substrate support may be either rigid or thin and flexible. If the substrate support is rigid, the operative surface of the head is plane and a paper conveyor device (not shown) conveys the paper into contact with the electrodes and the counter-electrodes. If the substrate support is thin and flexible, the multi-layer printed circuit encloses a rigid support to form a printing head similar to that of FIG. 1.

In FIG. 4 the spaces between the electrodes 13A and 13B themselves and between the electrodes 13A and 13B on one hand, and the counter-electrodes 14A and 14B on the other hand are illustrated as coated with an anti-abrasive layer 37, for example of silicon carbide, having a thickness slightly greater than that of the counter-electrodes.

What we claim is:

1. A printed circuit electrostatic printing head comprising a rigid dielectric plate having a face with an edge extending from the face, dielectric sheet means with first and second portions respectively extending in abutting relation over the face and edge, a set of spaced electrostatic printing electrodes extending through the second portion of the sheet means between opposite first and second faces of the second portion, said first portion of the dielectric sheet means including: a first set of parallel electric leads on a first face of the sheet means abutting against the face of the plate, the leads of the first set being in electrical contact with the electrodes and extending at right angles to the edge, a second set of parallel electric conductors on a second face of the sheet means opposite from the first face of the sheet means, the second set of leads extending in a direction at right angles to the first set of leads whereby a matrix of leads is formed on the opposite faces of the first portion, and contacts extending through the first portion between segments of the first and second sets of leads in register with each other to form electrical connections between selected leads of the first and second sets.

2. A printed head for an electrostatic point printer comprising:

a rigid substrate support having the shape of a rectangular prism having two large lateral faces and a narrow front face;

a flexible dielectric substrate sheet, said sheet having first and second faces with a thickness between the first and second faces;

a connector mechanically connected to said substrate support and responsive to signals for controlling printing;

a plurality of first parallel conductive leads extending in a first direction printed on the first face of said substrate sheet electrically connected to the connector to be responsive to the signals;

aligned electrode studs passing through said thickness of said substrate sheet, each of said studs being in ohmic contact with a respectived one of said first conductive leads and being flush with said substrate sheet second face;

a plurality of parallel second conductive leads extending in a second direction perpendicular to said first direction, printed on said second face of said substrate sheet;

through contacts passing through said thickness of said substrate sheet, each of said contacts making an ohmic contact between one of the first leads and one of the second leads; and said first face of said substrate sheet being bonded to said lateral and front faces of the substrate support, said electrode studs being aligned along said narrow front face.

3. A printing head as set forth in claim 2 in which said through contacts are walls of plated through holes.

4. A printing head as set forth in claim 2 in which alternate ones of the electrode studs are aligned along two closely spaced apart straight lines parallel to said second direction.

5. A printing head as set forth in claim 2 further comprising counter electrode electrically conductive areas on said substrate sheet second face, formed by large conductive tracks parallel to the electrode stud alignment on each said thereof.

6. A printing head as set forth in claim 5 in which the counter electrode conductive areas are located on those parts of the substrate sheet which are glued to the parts of the substrate support forming a transition between the narrow face thereof and the two large faces.

7. A printed circuit electrostatic printing head comprising a rigid dielectric plate having first and second faces with first and second edges extending between them, dielectric sheet means with first, second and third portions respectively extending in abutting relation over the first and second faces and one of said edges, a set of spaced electrostatic printing electrodes extending through the third portion of the sheet means between opposite first and second faces of the third portion, each of said first and second portions of the dielectric sheet means including: a first set of parallel electric leads on a first face of the sheet means abutting against the faces of the plate, the leads of the first set being in electrical contact with the electrodes and extending at right angles to the first edge, a second set of parallel electric leads on a second face of the sheet means opposite from the first face of the sheet means, the second set of leads extending in a direction at right angles to the first set of leads whereby a matrix of leads is formed on the opposite faces of each of the first and second portions, and contacts extending through the first and second portions between segments of the first and second sets of leads in register with each other to form electrical connections between selected leads of the first and second sets; and a connector extending over the second edge with contacts electrically connected to the leads of one of the sets.

8. The apparatus of claim 7 wherein the electrodes are arranged in first and second parallel displaced rows that extend along the first edge, the electrodes of the first row being displaced along the direction that the rows extend from the electrodes of the second row, the electrodes of the first and second rows being respectively connected to the first set of parallel leads of the first and second portions of the dielectric sheet means.

9. The apparatus of claim 7 or 8 further including first and second sets of counter electrodes on the second face of the sheet means respectively extending between the first and third portions of the sheet means and between the second and third portions of the sheet means, and leads on the second faces of the sheet means connecting the first and second sets of counter electrodes to contacts of the connector without contacting the conductors of the first and second sets of leads.

10. The apparatus of claim 9 wherein the contacts extending between the segments are metal plated walls of through holes in the first and second portions of the sheet means.

* * * * *